United States Patent [19]

Ross et al.

[11] Patent Number: 4,662,452

[45] Date of Patent: May 5, 1987

[54] INJECTION CONTROL DEVICE FOR SUBTERRANEAN WELL CONDUIT

[75] Inventors: Richard J. Ross; Joseph N. Klumpyan, both of Houston, Tex.

[73] Assignee: Baker Oil Tools, Inc., Orange, Calif.

[21] Appl. No.: 826,365

[22] Filed: Feb. 5, 1986

Related U.S. Application Data

[63] Continuation-in-part of Ser. No. 790,876, Oct. 24, 1985.

[51] Int. Cl.[4] ..... E21B 34/12

[52] U.S. Cl. ..... 166/334; 166/373

[58] Field of Search ..... 166/332, 334, 373, 386, 166/305.1

[56] References Cited

U.S. PATENT DOCUMENTS

| | | | |
|---|---|---|---|
| 2,974,922 | 3/1961 | Keithahn | 166/334 X |
| 3,960,366 | 6/1976 | Abney et al. | 166/334 X |
| 4,192,378 | 3/1980 | Baker et al. | 166/334 X |
| 4,458,762 | 7/1984 | McMahon | 166/334 X |
| 4,576,196 | 3/1986 | Ross et al. | 166/318 X |
| 4,605,062 | 8/1986 | Klumpyan et al. | 166/332 X |

*Primary Examiner*—Stephen J. Novosad
*Assistant Examiner*—David J. Bagnell
*Attorney, Agent, or Firm*—Norvell & Associates

[57] ABSTRACT

A downhole injection valve for selectively opening and closing the bore of a tubing string to permit the passage of chemical treatment fluid at a preselected flow rate to a downhole tool comprises a first annular valve element mounted in a valve housing which is connected in a tubing string above the downhole tool. A slip joint is connected between the valve housing and the downhole tool to permit relative upward and downward movement of the valve housing with respect to the tool. A second annular valve element is disposed in surrounding relationship to a support rod which is inserted in the tubing string and supported at its bottom end by the downhole tool. Upward movement of the tubing string effects contact of the first and second annular valve elements to close all fluid flow through the bore of the tubing string. Conversely, downward movement of the tubing string will effect axial separation of the valve elements to permit fluid flow through the tubing string to the downhole tool. An orifice ring secured to the support rod and the bore of the valve housing is contoured to provide a preselected annular orifice in the flow path of the fluid to the downhole tool, thus regulating the rate of supply of such fluid.

17 Claims, 25 Drawing Figures

INJECTION CONTROL DEVICE FOR SUBTERRANEAN WELL CONDUIT

RELATIONSHIP TO OTHER CO-PENDING APPLICATIONS

This application constitutes a continuation-in-part of application Ser. No. 790,876, filed Oct. 24, 1985.

BACKGROUND OF THE INVENTION

1. Field of the Invention

The invention relates to a method and apparatus for effecting the opening and closing of a well conduit extending to a downhole tool to permit the injection of predetermined amounts of treating fluid down the conduit to the downhole tool at a preselected rate.

2. History of the Prior Art

Many producing wells have low fluid levels, i.e., the levels of fluid in the casing annulus surrounding the production conduit does not extend upwardly from a production zone to any substantial extent, hence the hydrostatic fluid pressure in the production conduit will always substantially exceed the fluid pressure existing in the casing annulus.

This presents a problem when it is desired to treat a production formation, or a portion thereof, with chemicals conventionally employed to enhance the productivity of wells. The perforation treating apparatus may be positioned so as to straddle a selected portion of the production zone and provide a fluid passage to such selected portion from the tubular work string or the production conduit. However, if it is only desired to inject a limited amount of chemical treating fluid at a selected rate of flow into the selected portion of the production zone, this becomes a matter of some difficulty since the low fluid pressure existing in the production zone would effectively rapidly drain any quantity of treating fluid contained in the tubular string. There is, therefore, a definitive need for an injection control valve which may be positioned in the tubular string conduit immediately above the downhole tool and controlled from the well surface to selectively open and close such conduit so as to permit only a predetermined amount of treating fluid to be supplied to the selected portion of the production zone being treated at a predetermined rate of flow. Injection control valves for this purpose have been known in the prior art, but have employed either springs or fluid pressures to shift the valve between its open and closed positions. This necessarily means that careful adjustment of the valve must be made before it is lowered into the well, in order to insure that the valve will function under the pressure conditions existing at the downhole location where the valve is positioned. Since these conditions are never known with great accuracy, this means that much intelligent guessing has to be made with respect to the proper amount of spring force or the proper amount of fluid pressure required to insure the reliable operation of the injection valve from its closed to its open position for the required duration.

Additionally, prior art injection control valves have not incorporated means for establishing a predetermined rate of flow of chemical treatment fluid into the production zone being treated.

SUMMARY OF THE INVENTION

This invention provides a method and apparatus for reliably effecting the opening and closing of an injection control valve mechanism disposed downhole in a tubing string solely by movement of the tubing string. A slip joint permitting limited movement of the tubing string relative to the downhole tool is connected to the downhole tool. Immediately above the slip joint, a tubular valve housing is connected in series relationship between the tubing string and the slip joint. Thus, the valve housing may be raised a limited distance by the tubing string and then lowered an equal distance. The valve housing further provides a fixed mounting for an annular valve element within its bore.

A second annular valve element is mounted on a support rod assembly which is positioned in inserted relationship with respect to the housing. Such support rod assembly is normally vertically supported by an upwardly facing surface of the downhole tool. Thus, the support rod assembly may be inserted in the valve and slip joint assembly prior to running into the well, or it may be lowered into position by wireline after the downhole tool, slip joint, valve housing and tubular string have been run into the well to the desired depth, or dropped into position through the tubing string.

In the collapsed position of the slip joint, the annular valving member carried by the valve housing is positioned in downwardly spaced relationship relative to the annular valve member surrounding the support rod assembly. Thus, an annular fluid passage is provided between the bore of the tubular string and the downhole tool to permit the passage of chemical treatment fluid into the downhole tool.

In this position, an orifice ring mounted on the support rod assembly is disposed in closely spaced relationship to a bore portion of the annular valve housing, thus defining an annular orifice which determines the rate of flow of chemical treatment fluid into the downhole tool. When sufficient fluid has been supplied, the well operator elevates the tubing string by an amount sufficient to bring the first mentioned annular valving member into axially abutting engagement with the second mentioned annular valving member and effects a sealing of the annular passage around the support rod assembly, hence cuts off any further fluid flow from the tubular conduit into the downhole tool. The valve is positively closed regardless of the fluid pressures existing adjacent to the valve.

One of the annular valving members is provided with an annular elastomeric seal element to provide greater sealing security, and the hydrostatic fluid pressure existing in the tubular string provides a downward force on the annular valve member carried by the support rod assembly to compress the annular elastomeric seal element between the two axially abutting valve members, thus assuring a good seal.

In the preferred embodiment of this invention, the annular valve element supported by the valve housing is not rigidly secured to the valve housing but can be moved upwardly relative to the valve housing by an outwardly projecting shoulder formed on the support rod assembly, for example, the orifice ring. Thus the support rod assembly may be conveniently removed at any time to provide a large diameter passage through the tubular string, valve housing and slip joint of the downhole tool. A further feature of the preferred embodiment of this invention comprises the utilization of a J-pin and slot connection between the valve housing and the stationary portion of the slip joint which is connected to the downhole tool. By the use of such J-slot, the valve housing may be positioned in any one of three vertical positions, the first position being the uppermost position of the valve housing wherein the two annular sealing members are in sealing contact, the second position being where the annular sealing members are axially spaced a substantial distance and the orifice ring is disposed adjacent the orifice defining bore portion of the valve housing. The third position is intermediate the first two positions and the orifice ring is positioned against a larger diameter bore portion of the valve housing thus permitting substantially a full flow rate of the chemical treatment fluid into the downhole tool.

When the two annular valving members are positioned in their aforementioned first or closed position, a radial port in the slip joint is opened to provide communication between the well annulus and the bore of the slip joint and interconnected tubular housing, thus assuring pressure equalization across the downhole tool so as to permit the operation of such tool without difficulty. Such pressure equalizing valving arrangement also permits a full flow of a circulating or flushing fluid to be supplied concurrently to the casing annulus above the packer or other downhole tool and to the bore of such downhole tool.

Further advantages of the invention will be readily apparent to those skilled in the art from the following detailed description, taken in conjunction with the annexed sheets of drawings, on which are shown a preferred embodiment of the invention.

BRIEF DESCRIPTION OF DRAWINGS

FIG. 1I schematically shows a packer connected to the bottom of the injection valve.

DESCRIPTION OF PREFERRED EMBODIMENT

Figure 1A:
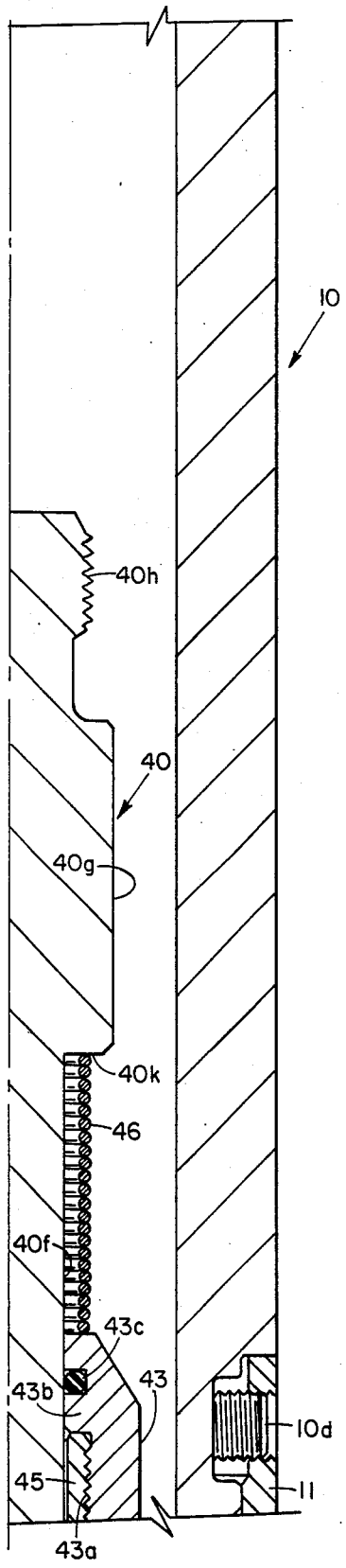
FIGS. 1A–1G collectively constitute a vertical sectional view of a injection valve embodying this invention, with the components of the valve shown in their open position.
Figure 2A:
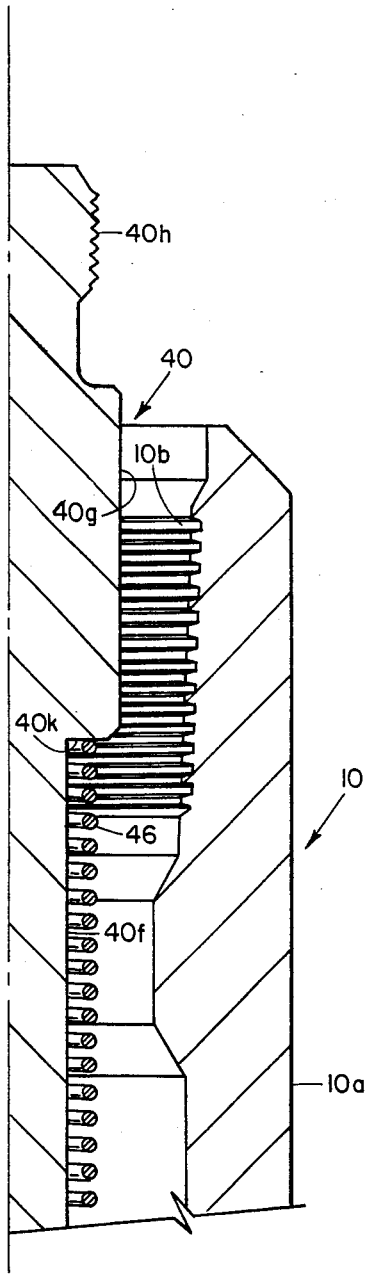
FIGS. 2A–2G respectively constitute views similar to FIGS. 1A–1G but showing the elements of the injection valve in their closed position.
Figure 3A:
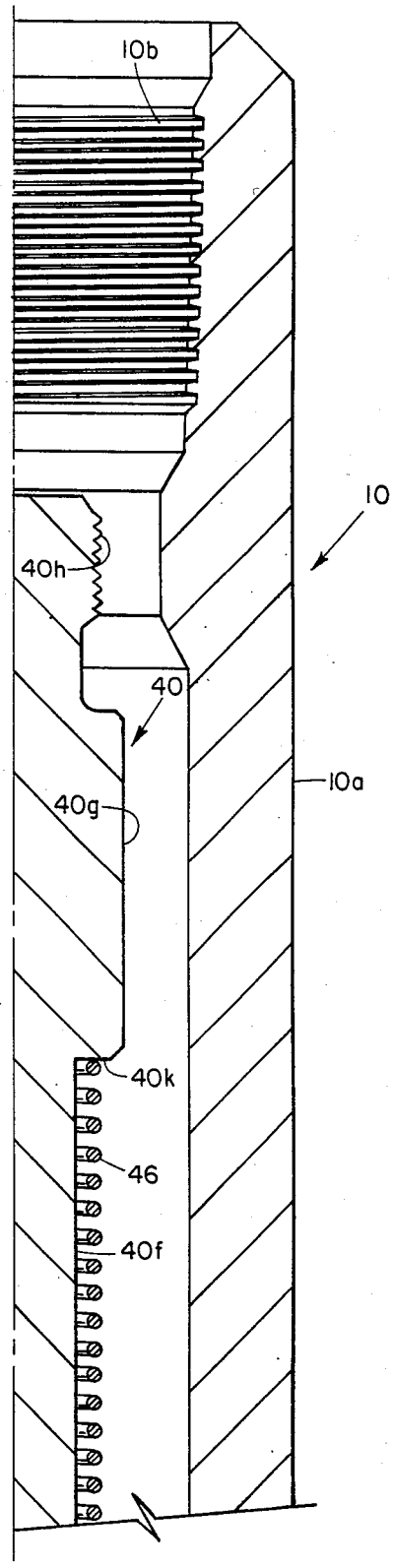
FIGS. 3A–3G respectively constitute views similar to FIGS. 1A–1G but showing the elements of the valve in an intermediate position wherein the valve is open for flow and a maximum flow area is provided through the valve.

Referring to the drawings, the injection valve mechanism embodying this invention comprises a series assemblage of three major tubular units between the bottom end of a tubing string and a conventional perforation treatment tool which is to be positioned at a desired location in the well by the tubing string. The top tubular unit comprises a valve housing assembly 10 which is connected at its top end to the bottom of the tubing string and at its bottom end to the top of a conventional slip joint 20. The bottom end of slip joint 20 is in turn conventionally connected to a mandrel or tubular conduit 30 extending to the downhole tool (not shown), which may comprise a washer, a chemical treatment tool similar to a washer, or a packer 100 supporting a washer or chemical treatment tool in adjacent relationship to a portion of the production formation for which chemical treatment is desired.

Valve housing assembly 10 comprises a tubular element 10*a* having internal threads 10*b* formed in its upper end for conventional securement to the bottom end of a tubing string (not shown). External threads 10*c* are provided on the bottom end of the tubular element 10*a* for connection to internal threads provided on a connector sub 11. An O-ring 11*a* seals the threaded connection and a set screw 10*d* effects the securement of this threaded connection. The lower portion of the connector sub 11 is provided with internal threads 11*b* for attachment to a movable mandrel element 22 of the slip joint 20. An O-ring 11*c* seals this threaded connection and a set screw 11*d* effects the securement of the threaded connection.

Mandrel 22 is axially slidable relative to a slip joint housing assembly 24 which surrounds the lower portion of mandrel 22 and is provided at its lower end with internal threads 24*a* for engagement with the upper end of a mandrel or connecting conduit 30 which extends downwardly to a downhole injection tool or packer 100 (FIG. 1I) which is suitably anchored in the well casing. The slip joint is of generally conventional construction, but is provided with a J-slot and pin connection between the slip joint mandrel 22 and the slip joint housing assembly 24. Thus, referring to FIGS. 1E and 1H, the slip joint mandrel 22 is provided with a J-slot 23 which is engaged by a key 26 which is rigidly assembled to the upper element of the housing 24 by a key retainer sub 28 having internal threads 28*a* engageable with external threads in the lower end of the housing element 25. An O-ring 25*a* seals this threaded connection and a set screw 28*c* secures the threaded connection.

From the foregoing description, it will be obvious to those skilled in the art that the valve housing assembly 10 may be moved axially relative to the downhole tool or packer 100 secured to the lower mandrel or conduit to the extent permitted by the limited axial movement of the key 26 relative to either the short leg 23*a* or the long leg 23*b* of the J-slot 23, thus limiting the axial movement of the slip joint mandrel 22 relative to the slip joint housing assembly 24. A wiper ring 24*b* in the upper end of the housing element 25 effects a sliding engagement with a cylindrical external portion 22*d* of the mandrel 22 during this axial movement to protect the J-slot mechanism from trash. FIGS. 1A through 1H of drawings represent the position of the elements of the injection tool device when the slip joint is in its fully extended position with the key 26 being disposed in the lower portions of the J-slot 23, while FIGS. 2A through 2G of the drawings represent the position of the elements when the key 26 is in the upper portions of the long leg 23*b* of the J-slot 23 and FIGS. 3A–3G represent the position of the tool when the key 26 is positioned in the top of the short leg 23*a* of the J-slot 23. Obviously, the key 26 may be moved to enter either the short leg 23*a* of the J-slot 23 or the long leg 23*b* by rotation of the tubing through a limited arcuate path.

A first annular valve element 12 (FIGS. 1B, 2C and 3B) is slidably and sealably mounted within the bore of the connecting sub 11 and normally rests on an internally projecting shoulder 11*e* formed in such bore. The sealable mounting of the annular valve element 12 is accomplished by a seal carrier sleeve 13 which is interposed between a counter bore 10*e* formed in the bottom end portion of the tubular element 10*a*, and is secured in that position by an upwardly facing shoulder 11*f* formed on the connecting sub 11. Molded seal 13*a* and O-ring seal 13*b* are respectively mounted on the inner and outer surfaces of the seal carrier sleeve 13. Seal 13*a* engages the external surface of the annular valve element 12, while seal 13*b* engages the internal surface 1O*e* of valve housing assembly 10. Valve element 12 axially extends upwardly and terminates in a valving protuberance 12*b* which will effect a sealing engagement with a second annular valve element 42 in a manner to be hereinafter described.

Annular valve element 12 has a bore 12*a* which is slightly constricted at its upper end to define a downwardly facing shoulder 12*c* for purposes of removal of the valve element 12, as will be hereinafter described. With the exception of the valve element 12, the aforedescribed elements constitute those components of the injection valving mechanism which may be permanently left downhole with the downhole tool or packer 100. It will be noted that the presence of these elements does not substantially obstruct the area of the axial passage defined by these elements between the bore of the tubing string and the bore of the downhole tool or packer, and this is particularily true when the first annular valving member 12 is removed from the well.

To function as an injection valve, a second annular valve element 42 is mounted on a support rod assembly 40 which extends downwardly through the entire length of the elements heretofore described and preferably is supported by an upwardly facing surface 101 provided on the downhole tool or packer 100. Rod assembly 40 may thus be carried into the well with the injection valve assemblage and the packer or downhole tool or inserted afterwards.

The support rod assembly 40 at its lower end comprises a solid rod 40*a* which extends from the lower portion of the valve housing 10 downwardly through the slip joint 20 and the conduit 30 into engagement with a suitable supporting surface (not shown) on the downhole tool or packer 100. Rod portion 40*a* terminates at its upper end in a cup-shaped portion 40*b* (FIG. 1C) which is provided with internal threads 40*c*. An extension rod portion 40*d* is threadably engaged with the internal threads 40*b* and is bored at its upper end to provide internal threads 40*e* to provide a threaded connection with the lower end of the upper section 40*f* of the support rod assembly 40. The upper portions of the top section 40*f* are provided with an enlarged shoulder 40*g* and, at the extreme upper end, with external threads 40*h* so as to permit convenient engagement of the support rod assembly by a wireline tool for removal of the entire support rod assembly.

Just above the threads 40*e*, the top section 40*f* of the support rod assembly 40 mounts a second annular valve member 42 which cooperates with the first annular valve member 12. Valve member 42 comprises a threaded assemblage of an annular seal retainer 43 in overlying relationship to a seal sub 45. Threads 43*a* effect the interconnection. Seal sub 45 is mounted in slidable relationship to the upper mandrel section 40*f* as is an inwardly enlarged portion 43*b* of the seal retainer 43, and an O-ring 43*c* makes this sliding connection a sealed connection. If desired, a light spring 46 may be provided between the upper end of seal 43 and the downwardly facing surface 40*k* defined by the radially enlarged shoulder 40*g* on the support rod assembly 40.

The seal retainer 43 and seal sub 45 cooperate to define an annular pocket at their lower ends of generally rectangular cross-sectional configuration within which an elastomeric seal element 44 is retained. A portion 44*a* of the bottom face of the annular seal element 44 is exposed, and this portion is aligned with the upstanding sealing protuberance 12*b* formed on the annular seal element 12 so that when the two annular seal elements 21 and 42 are moved into abutting engagement, a seal is provided by the contact of protuberance 12*b* with the exposed face 44*a* of the elastomeric seal element 44.

The primary purpose of the light spring 46 is to maintain the seal retainer 43 in an axially downwardly displaced position to more quickly engage and effect a seal with the first annular seal element 12 as such seal element is moved upwardly by upward movement of the tubing string. The spring 46 is not necessary to maintain the effectiveness of the seal between the annular elastomeric element 44 and the sealing protuberance 12*b*, since the presence of any fluid in the bore of the tubing string will create a fluid pressure differential urging the seal retainer 43 downwardly and thus effect a good sealing relationship between the two seal elements.

Those skilled in the art will readily appreciate the operation of the aforedescribed injection valve. When it is desired to move the injection valve from its open position shown in FIGS. 2A–2G, it is only necessary to elevate the tubing string by an amount sufficient to bring the first annular valve element 12, which is secured to the housing 10, upwardly into abutting engagement with the second annular valve element 42, as shown in FIGS. 1A–1G. In this position, all fluid flow through the annulus surrounding the support rod assembly 40 is effectively prevented.

To start fluid flow, it is only necessary to add weight to the tubing string to cause the slip joint 20 to move to its contracted position, and thus cause a separation of the first annular valve element 12 from the second annular valve element 42. In this connection, it should be noted that the second annular valve element 42 can only move downwardly relative to the support rod assembly 40 by a limited amount determined by the contact of the J-pin 26 with the top of the elongated leg 23*b* of the J-slot 23. Thus, positive opening and closing of the injection valving mechanism is assured and no reliance upon springs or fluid pressures is required. When the desired amount of upward tubing string movement is accomplished, the operator is assured that the injection valve is closed. Conversely, a corresponding downward movement of the tubing string will assure the opening of the injection valve. Hence, very accurate control of the amount of chemical treating fluid injected into the well may be readily obtained and the operator need not be concerned in any manner with the fluid pressure conditions existing in the vicinity of the injection valve.

Another feature of the injection valve embodying this invention is the provision of means for predetermining the flow rate at which the chemical treatment fluid will be introduced into the downhole tool, hence into the production formation to be treated. For this purpose, an orifice member 50, preferably a ring, is mounted on the intermediate portion 40*d* of the control rod assembly 40 by being trapped between a downwardly facing shoulder 40*m* provided on control rod assembly portion 40*d* and the upper end of the lower portion 40*a* of the control rod assembly 40. Orifice ring 50 mounts an O-ring seal 50*a* to provide a sealing engagement with the control rod assembly portion 40*d*. Additionally, the orifice ring 50 is radially outwardly enlarged by the provision of a shoulder 50*b* which projects into the annular flow path produced for the treatment fluid whenever the valve elements 12 and 42 are separated.

Figure 2C:
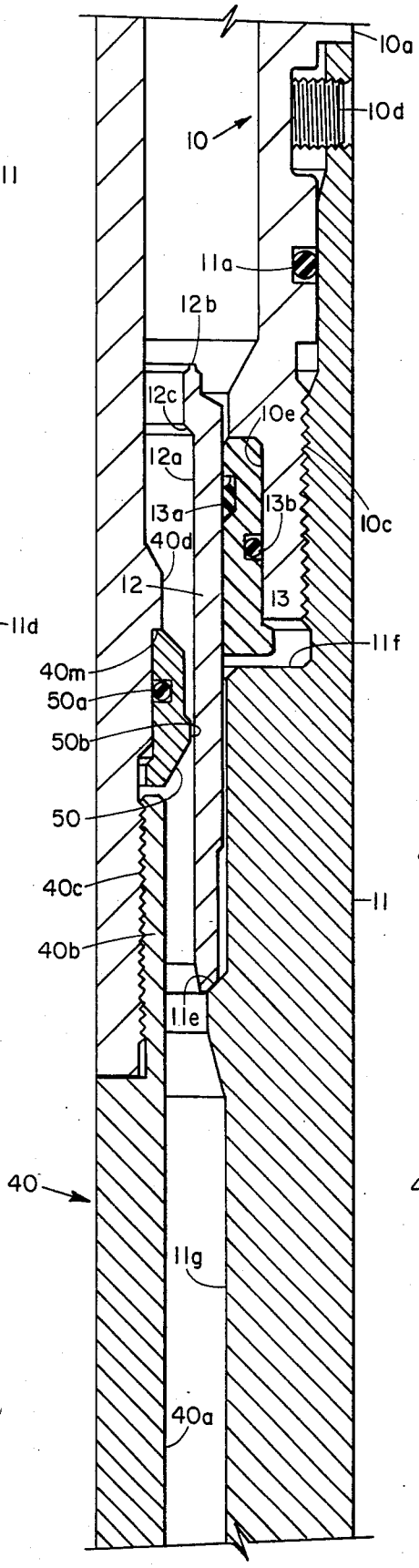

As best shown in FIG. 2C, the orifice ring 50 is preferably positioned on the control rod assembly 40 so as to bring it into the bore 12*a* of the annular valve member 12. The radial spacing between the orifice ring projection 50*b* and the bore 12*a* thus defines an annular orifice which controls the rate of flow of chemical treatment fluid downwardly to the downhole tool whenever the valve elements 12 and 42 are axially shifted to their open position.

Figure 1B:
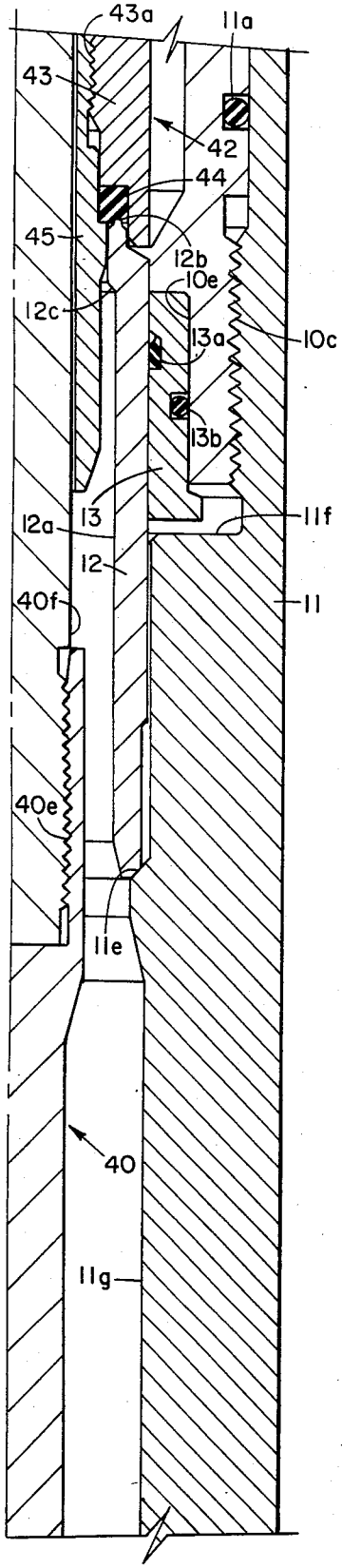
Figure 2B:
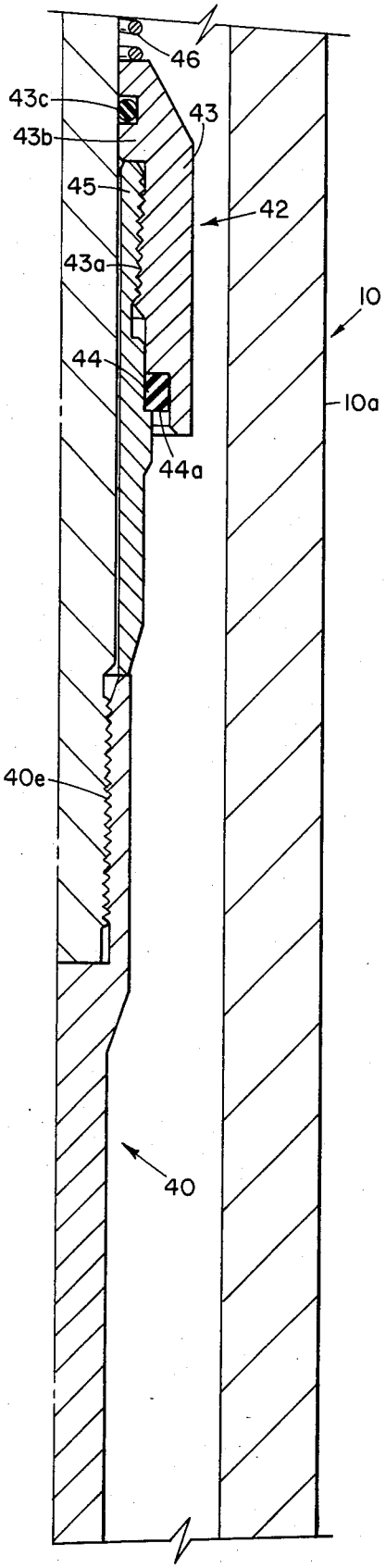
Figure 1C:
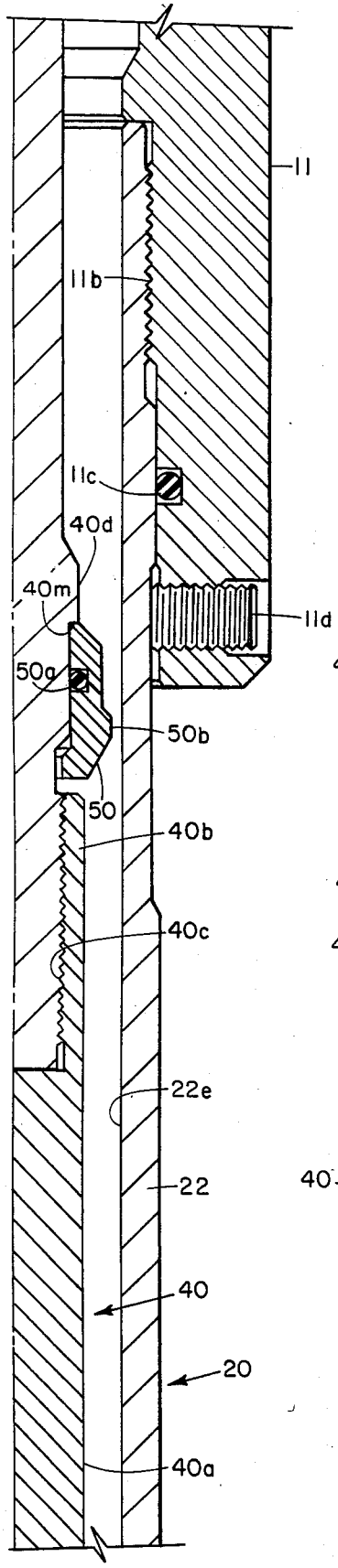
Figure 1D:
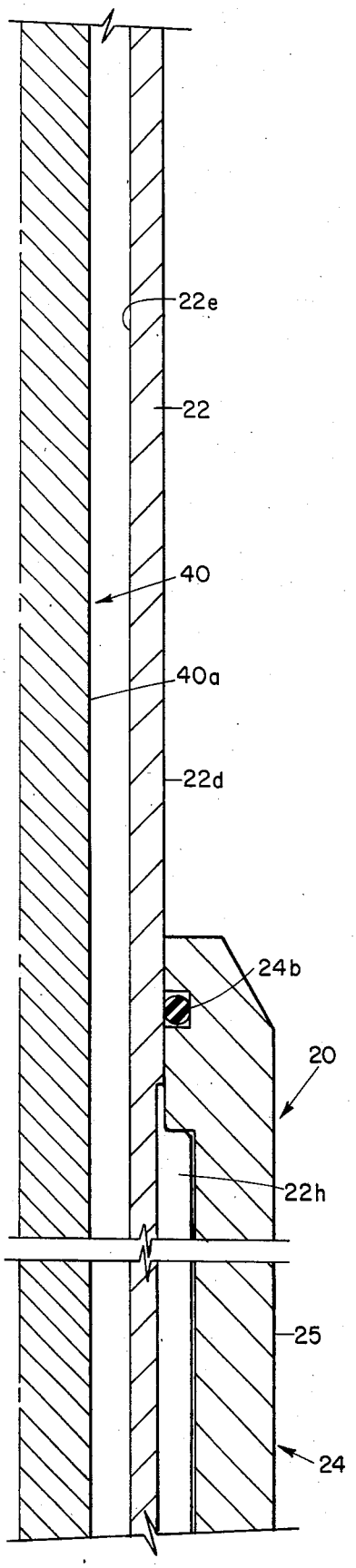
Figure 1E:
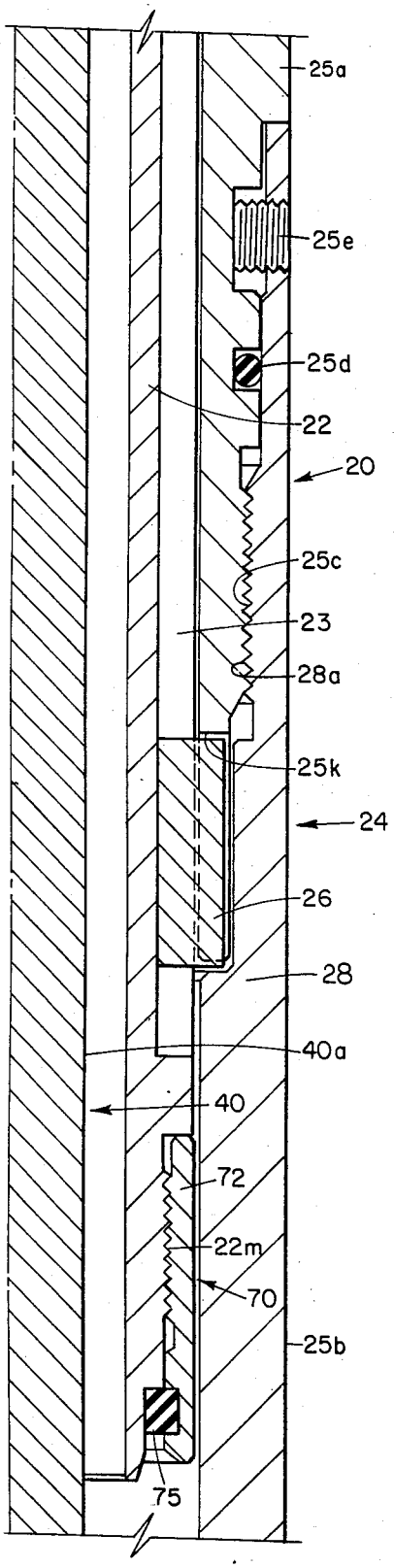
Figure 3E:
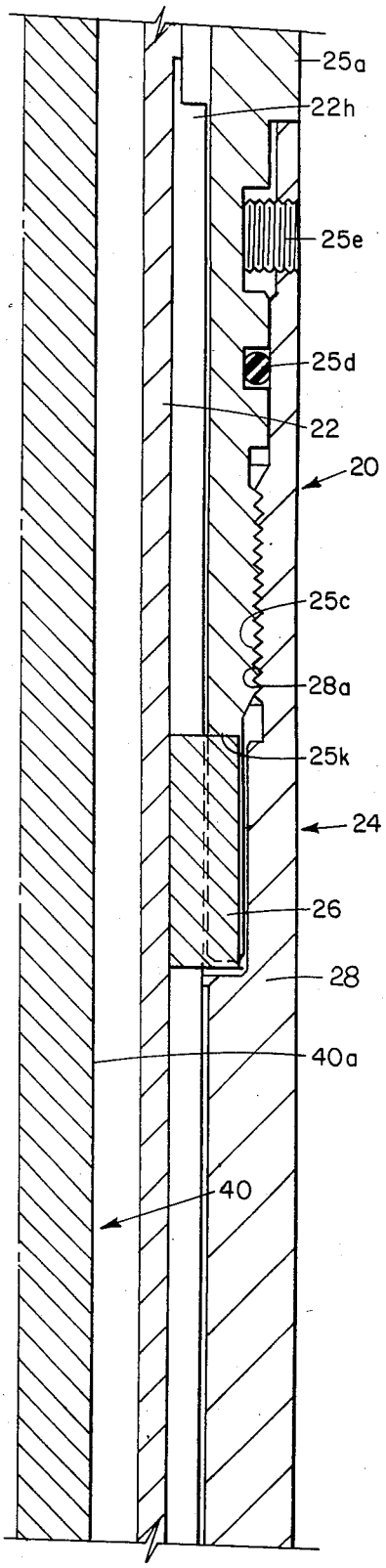
Figure 1F:
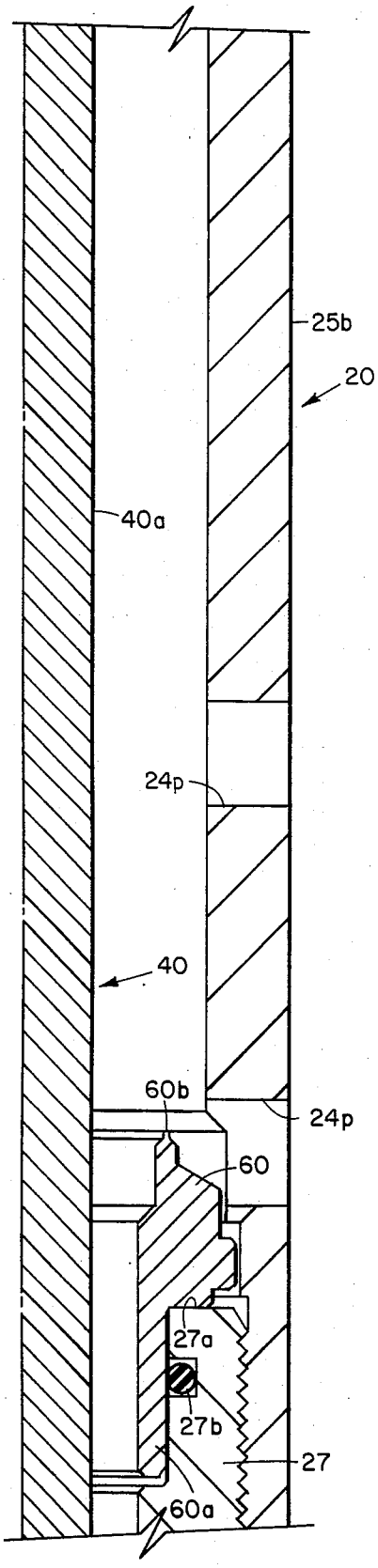
Figure 1G:
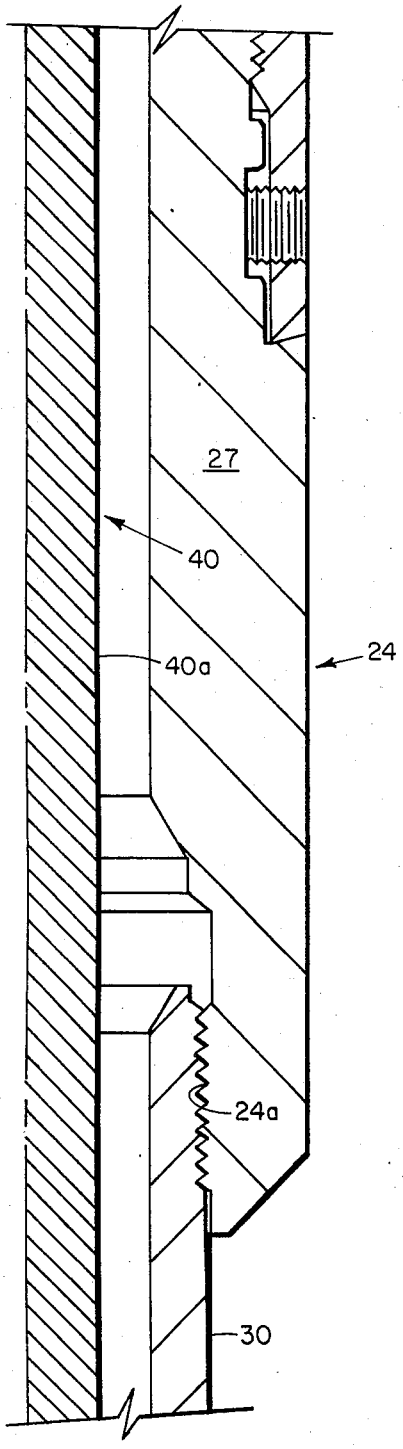
Figure 1H:
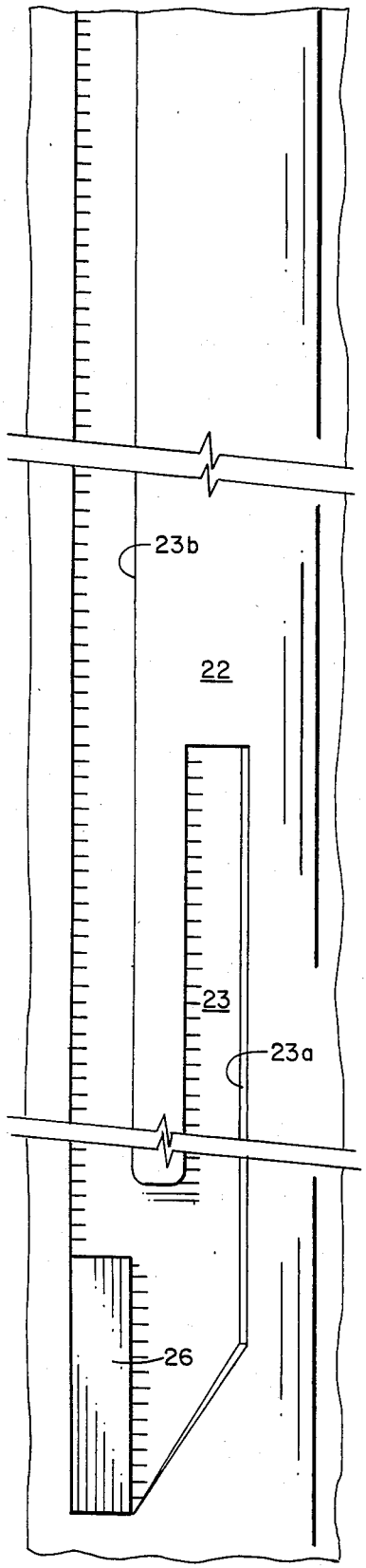
FIGS. 1H, 2H and 3H each comprise developed views showing the position of a J-pin in a J-slot for each of the valve positions.
Figure 2H:
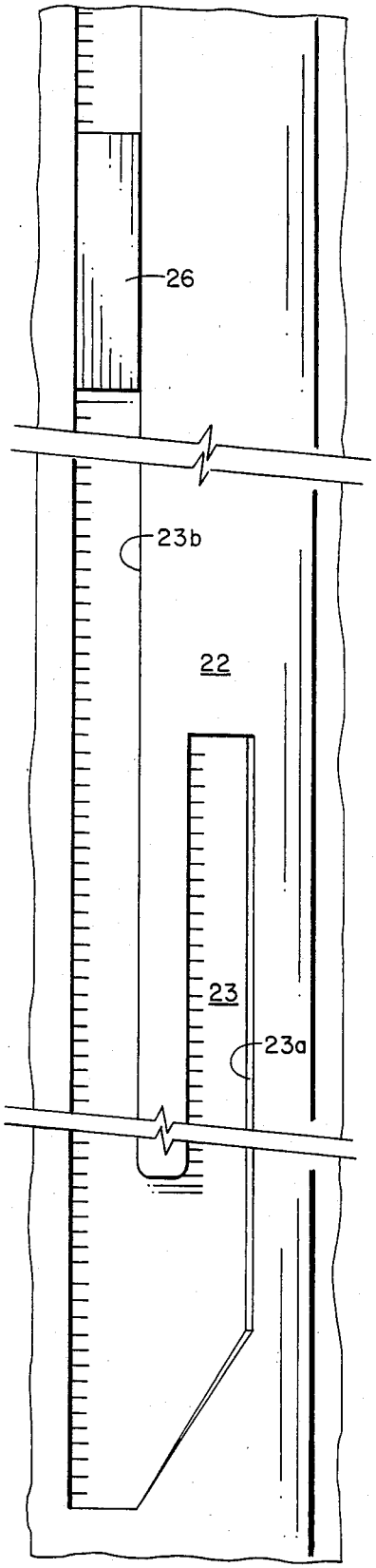
Figure 3H:
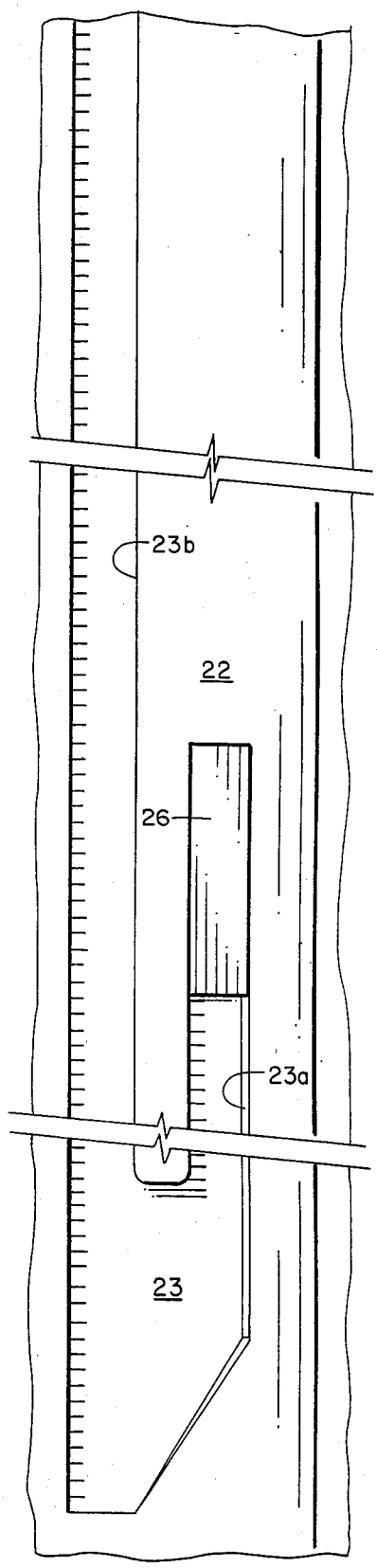
Figure 11:
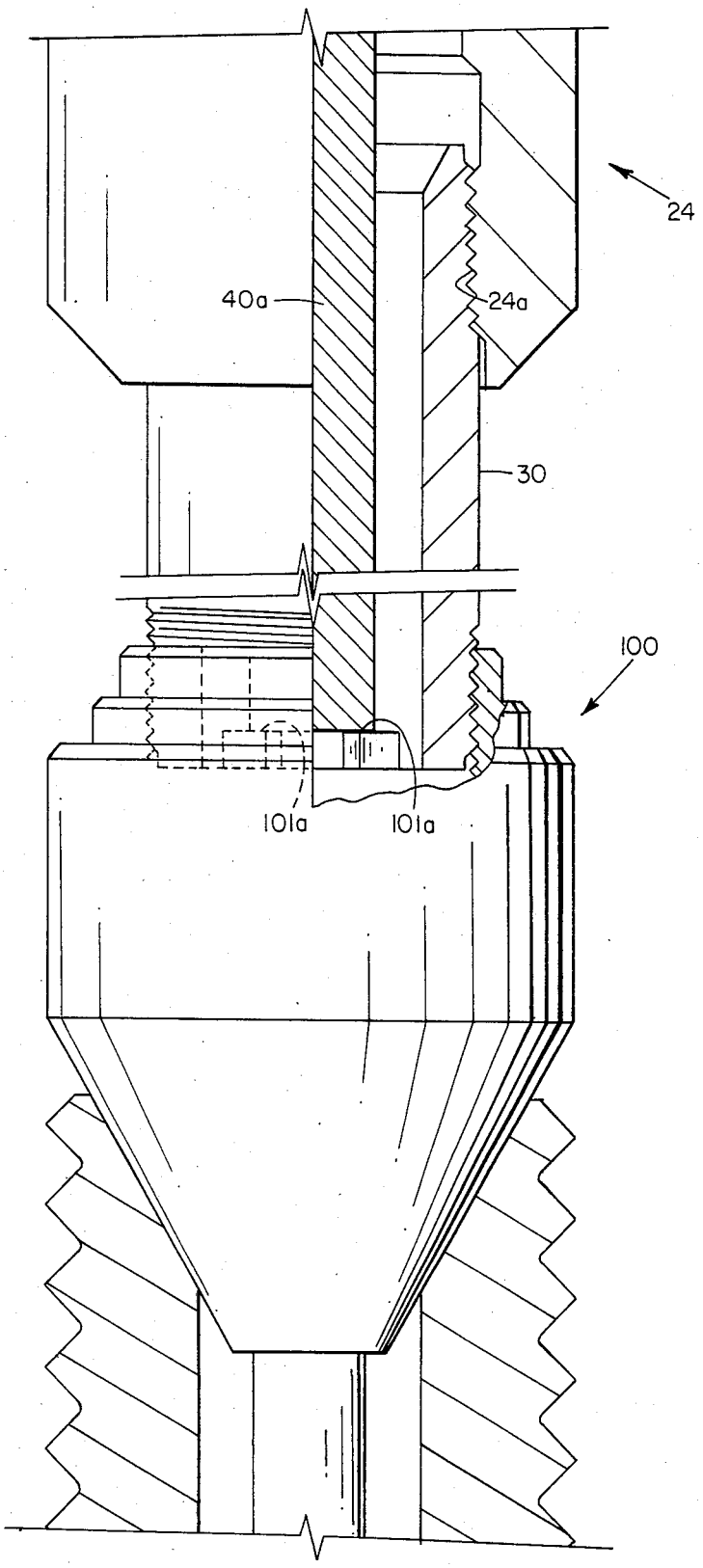

In the closed position of valve elements 12 and 42, illustrated in FIGS. 1B and 1C, the orifice ring 50 is positioned adjacent a larger diameter internal bore 22*e* defined by the mandrel 22. Thus, the orifice defined by the orifice ring 50 is of much greater radial width, thus preventing the accumulation of particulate deposits or debris in the orifice.

Figure 3B:
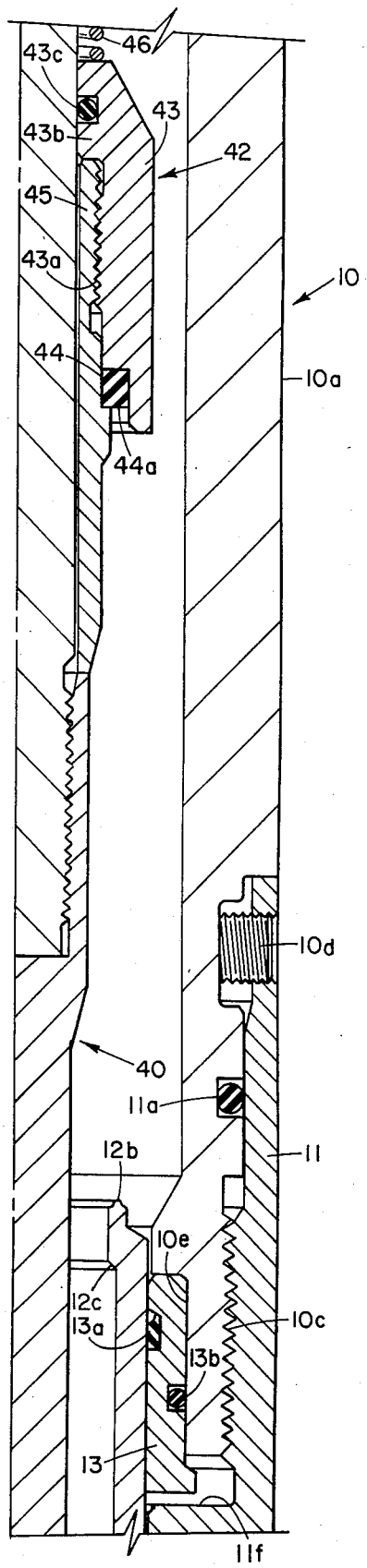
Figure 3C:
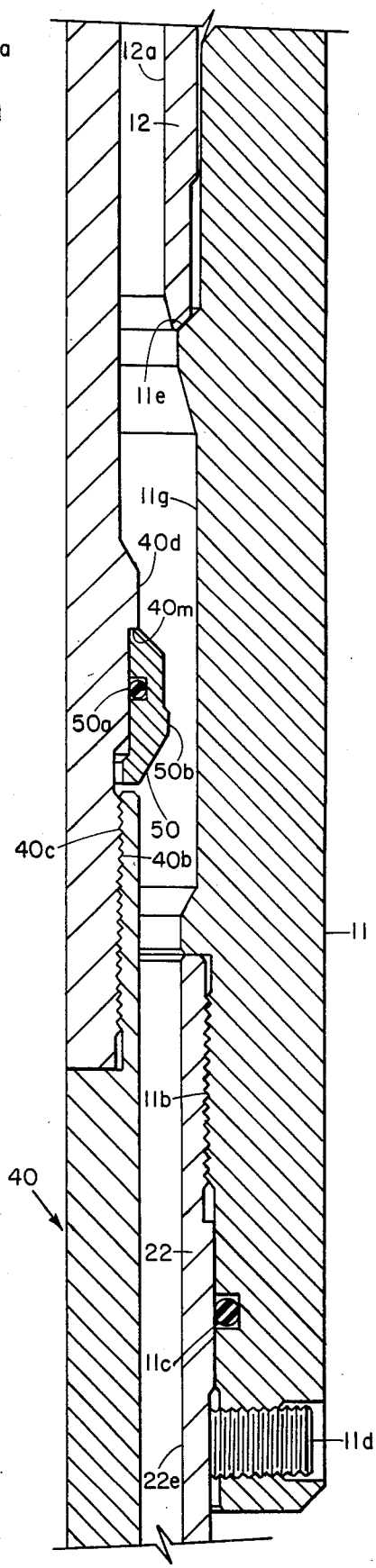
Figure 2D:
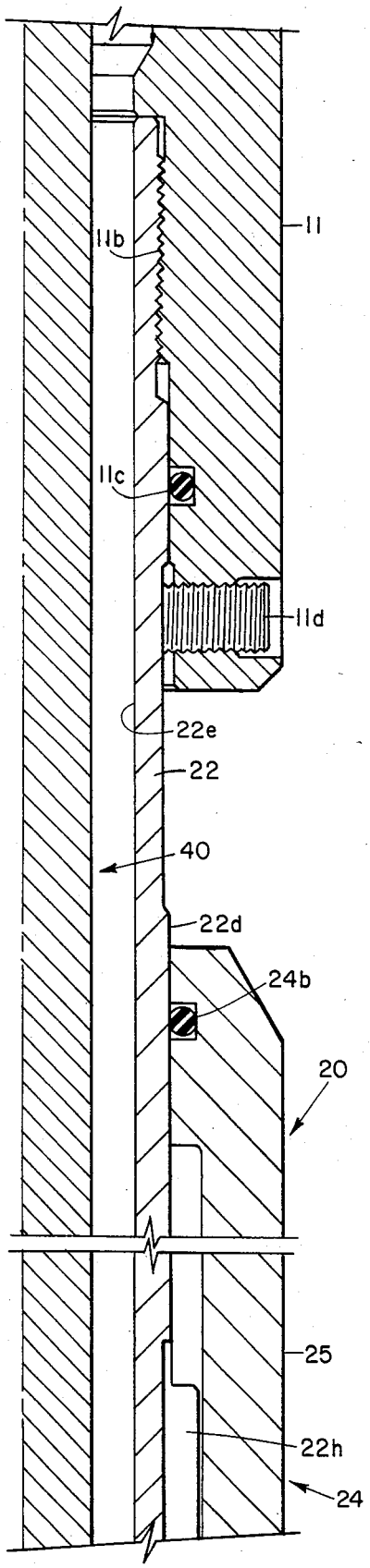
Figure 3D:
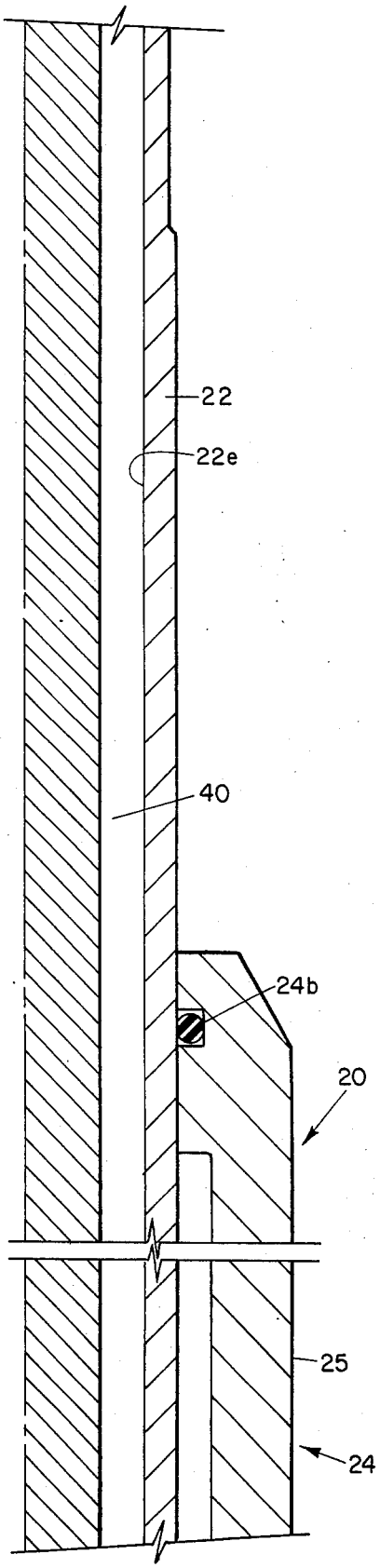

Referring now to FIGS. 3B and 3C, the elements of the injection valve mechanism are shown in an intermediate open position, as determined by the entry of the key 26 in the short leg 23*a* of the J-slot 23. In this position, the valving elements 12 and 42 are still axially spaced apart a substantial distance permitting free flow of chemical treatment or flushing fluid through the annular passageway defined between the support rod assembly 40 and the interior of the valve housing 10. In this position, an enlarged annular recess 11*g* formed in the bore of the connecting sub 11 is positioned opposite the orifice ring 50 so that the annular passageway now defined between the orifice ring and the wall of the recess 11*g* is sufficiently large to provide substantially unimpeded flow of treating or flushing fluid through the bore of the injection tool, and hence into the formation. Thus, this invention provides selective control of the rate of fluid flow of the chemical treatment fluid between two substantially different flow rates and the magnitude of the two flow rates can be predetermined by appropriate dimensioning of the orifice defined by the orifice ring 50 in either of its two positions represented by FIGS. 2C and 3C.

In the event that aforedescribed injection valving mechanism is to be employed with a packer which is difficult to unset in the presence of a fluid pressure differential between the tubing bore and the casing annulus above the packer, a tool embodying this invention may incorporate, as a convenient additional feature, an unloading valve for equalizing the pressure between the bore of the tubing string and the casing annulus at a point below the injection valve and when the injection valve is in its closed position. Such unloader valve is, of course, closed when the injection valve is in its fully open position.

Figure 2E:
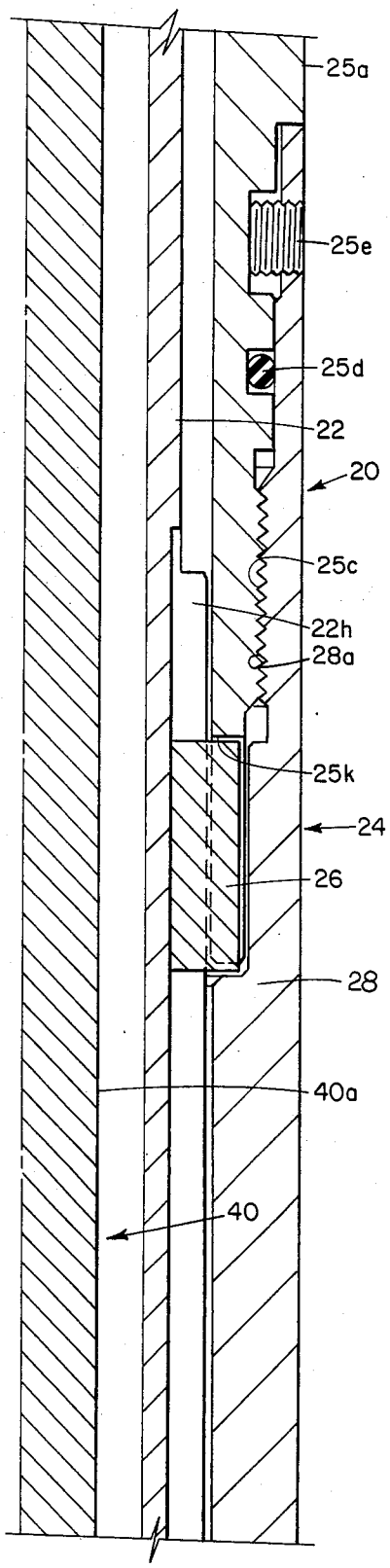
Figure 2F:
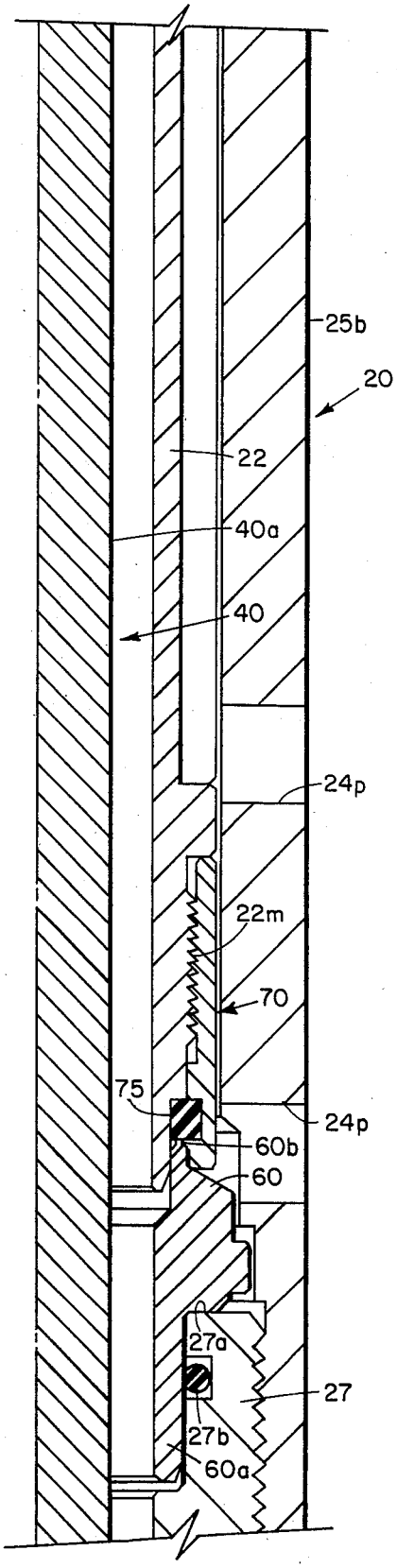
Figure 3F:
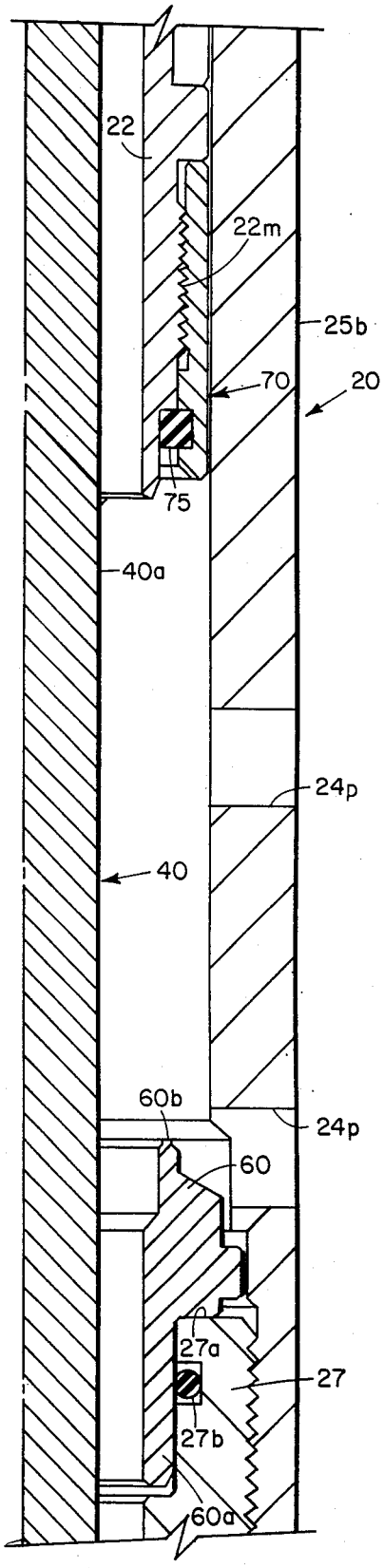
Figure 2G:
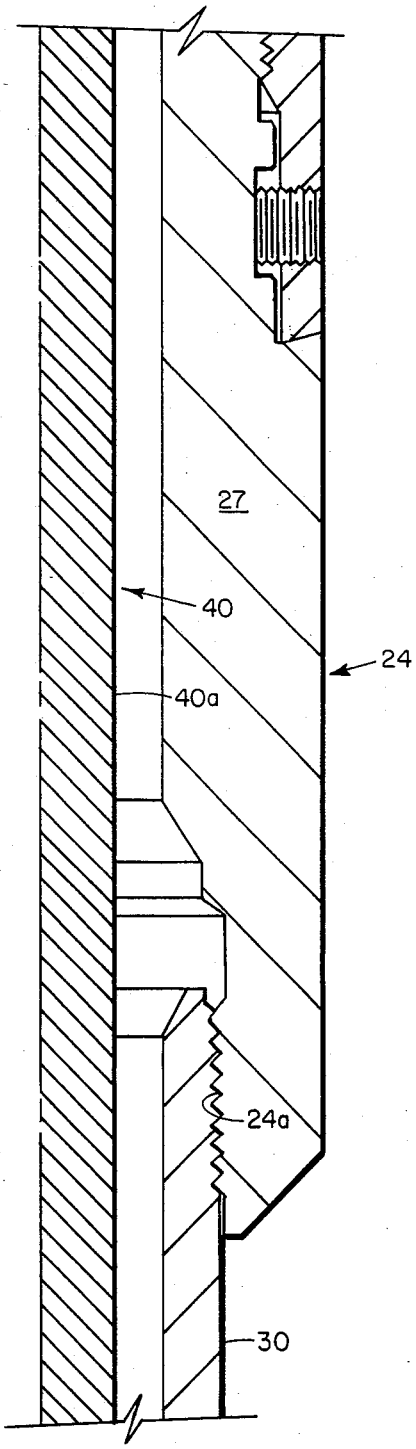
Figure 3G:
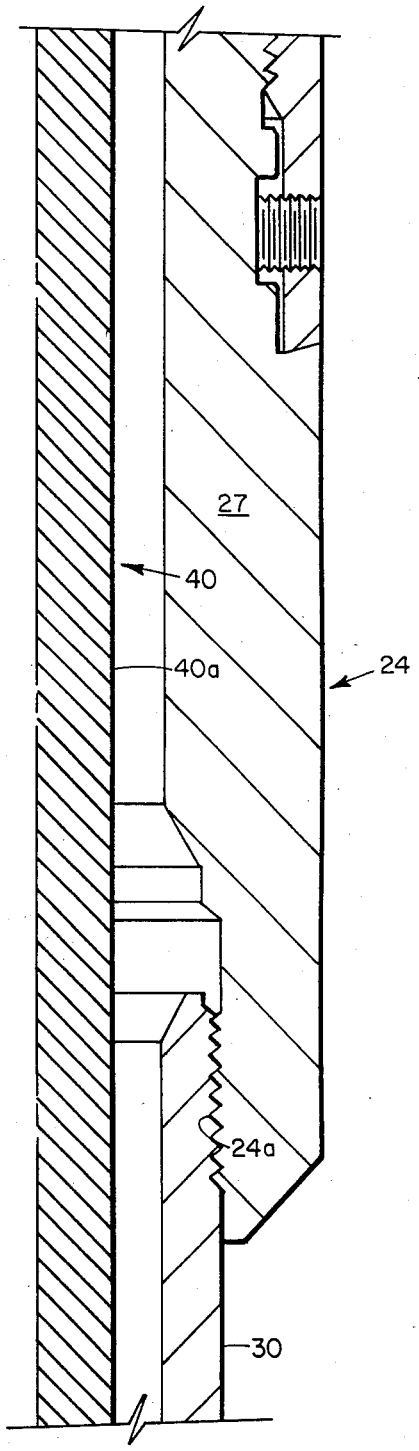

Referring particularly to FIGS. 1E, 1F, 2E and 2F, an unloading valve comprises a lower valving member 60 which is sealably seated on the top surface 27*a* of the lower tubular portion 27 of the slip joint housing assembly 24. An O-ring seal 27*a* effects a sealing of the external surface 60*a* of the unloader valve component 60. Unloader valve component 60 defines an upstanding annular protuberance 60*b* which is sealably engagable with an annular elastomeric mass 75 supported by an upper annular valving assemblage 70 (FIG. 2F). The annular elastomeric seal element 75 is secured to the bottom end of mandrel 22 by threads 22*m* and defines a pocket for reception of the annular elastomeric seal element 75 which has a generally rectangular cross section.

From the foregoing description, it is apparent that the upper valving assembly 70 is movable with the mandrel 22 of the slip joint 20. Accordingly, when the slip joint 20 is moved upwardly to effect the closing of the injection valve elements 12 and 42, as shown in FIG. 1B, the valving elements 60 and 70 of the unloading valve will be axially spaced apart and hence in an open position. This permits unrestricted fluid flow from the bore of the mandrel 22 through one or more radial ports 24*p* provided in the upper portion 25 of the slip joint housing assembly 24, thus equalizing the fluid pressure differential existing between the bore of the tubing string below the closed valving elements 12 and 42 and the casing annulus above the downhole tool.

When the mandrel 22 is shifted downwardly by manipulation of the tubing string, the injection valving elements 12 and 42 are separated and hence opened, and at the conclusion of the downward movement, the unloading valve is closed through the engagement of the annular elastomeric seal 75 with the upstanding protuberance 60*b*. Thus the treatment fluid will not escape to the annulus through the ports 24*p* when the injection valve is in its fully opened position.

On completion of the chemical treatment operations, the mandrel support rod 40 may be removed from the well by a wireline tool and, as previously mentioned, such removal movement also effects the removal of the annular valve member 12 through the engagement of the orifice ring 50 with the downwardly facing shoulder 12*c* of the valve member 12. The injection tool components left in the well will not impair future production or workover operations in the well since they define a substantially unimpeded fluid passage to any downhole tool or packer.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly modifications are contemplated which can be made without departing from the spirit of the described invention.

What is claimed and desired to be secured by Letters Patent is:

1. Valving mechanism for a well conduit communicating with a downhole tool comprising a hollow valve housing connected in series relationship with the well conduit; a slip joint connected in series relationship with the well conduit intermediate said hollow valve housing and the downhole tool; whereby said hollow valve housing may be shifted axially by the well conduit between two positions without moving the downhole tool; a first annular valve element sealingly mounted within the bore of said hollow valve housing and axially shiftable with said valve housing; a support rod insertable within the bore of said hollow valve housing to define an annular fluid passage therebetween; a second annular valve element sealingly mounted on the exterior of said support rod, whereby axial movement of said valve housing to the first of said positions moves said first and second valve elements into axially abutting engagement to close said annular fluid passage, thereby preventing fluid flow through the conduit to the downhole tool, and axial movement of said valve housing to the second of said positions axially separates said first and second valving elements to open said annular fluid passage and permit fluid flow from the conduit to the downhole tool; an orifice member externally mounted on said support rod, said member projecting radially into said annular fluid passage to define a constricted annular orifice in said annular fluid passage when said valve housing is axially shifted to said second position.

2. The apparatus defined in claim 1 wherein said valve housing defines a larger diameter bore adjacent said orifice member when said valve housing is moved axially to said first position to minimize trash accumulation between said orifice member and said housing.

3. The apparatus defined in claim 1 wherein said valve housing is axially shiftable to a third axial position intermediate said first and second positions wherein said valving elements are axially separated; said hollow valve housing defining an annular recess in its bore that is alignable with said orifice member in said third position to permit substantially unimpeded fluid flow around said orifice member.

4. The apparatus of claim 3 further comprising a J-slot and pin connection in said slip joint, thereby permitting the axial positioning of said valve housing selectively at said first, second or third positions.

5. The apparatus defined in claim 1 wherein said first annular valve element is supported on an upwardly facing surface of said valve housing but is freely movable upwardly, and abutment means on said support rod engageable with said first annular seal element to remove said first annular seal element.

6. The apparatus of claim 5 wherein said abutment means comprises an annular orifice ring externally mounted on said support rod, said ring projecting radially into said annular fluid passage to define a constricted annular orifice in said annular fluid passage when said valve housing is axially shifted to said second position.

7. The apparatus defined in claim 6 wherein said valve housing defines a larger diameter bore adjacent said orifice ring when said valve housing is moved axially to said first position to minimize trash accumulation between said ring and said housing.

8. The apparatus defined in claim 6 wherein said valve housing is axially shiftable to a third axial position intermediate said first and second positions wherein said valving elements are axially separated; said hollow valve housing defining an annular recess in its bore that is alignable with said orifice ring in said third position to permit substantially unimpeded fluid flow around said orifice ring.

9. The apparatus of claim 1 further comprising a J-slot and pin connection in said slip joint, thereby permitting the axial positioning of said valve housing selectively at said first or second positions.

10. The apparatus of claim 1 further comprising valve means in said slip joint for opening a fluid connection immediately above the downhole tool between the well annulus and the bore of the well conduit.

11. The apparatus of claim 1 wherein said slip joint comprises a tubular housing and a tubular mandrel slidably mounted within the bore of said tubular housing; means for connecting the bottom of said tubular housing to the downhole tool; means for connecting the top of said mandrel to said hollow valve housing; a radial port in the lower portions of said tubular housing, and valve means responsive to upward movement of said hollow valve housing for opening said radial port when said first and second valve elements are in said passage closing position.

12. An injection control valve for treating a production formation of a subterranean well comprising packer means settable adjacent to the formation to be treated; a hollow mandrel extending upwardly from said packer means; an upwardly facing abutment surface on said packer means located within said mandrel; a hollow valve housing; slip joint means connecting the lower end of said valve housing to the upper end of said mandrel; means for connecting the upper end of said valve housing to a tubing string; a support rod axially traversing said valve housing and said mandrel and supported by said upwardly facing abutment surface thereby defining an annular fluid passage through the bore of said hollow valve housing; a first annular valve element sealingly surrounding said rod; a second annular valve element sealingly secured to said hollow valve housing within the bore thereof, whereby a first axial position of said hollow valve housing engages said first and second annular valve elements in sealing relation to close said annular fluid passage and a second axial position of said hollow valve housing separates said first and second valve elements to open said annular fluid passage; and means for constricting the bore of said hollow valve housing member when said hollow valve housing is in said second position, thereby restricting fluid flow through said annular fluid passage.

13. The apparatus defined in claim 12 wherein said means for constricting the bore of said hollow valve housing comprises an orifice ring mounted on said support rod; and said valve housing defines a larger diameter bore adjacent said orifice ring in said first position to minimize trash accumulation between said orifice ring and said housing.

14. The apparatus defined in claim 12 wherein said valve housing is axially shiftable to a third axial position intermediate said first and second positions wherein said valving elements are axially separated; said hollow valve housing defining an annular recess in its bore that is alignable with said orifice ring in said third position to permit substantially unimpeded fluid flow around said orifice ring.

15. The apparatus defined in claim 12 wherein said second annular valve element is supported on an upwardly facing surface of said valve housing but is freely movable upwardly, and abutment means on said support rod engageable with said first annular value element to remove said first annular seal element.

16. Valving mechanism for a well conduit communicating with a downhole tool comprising a hollow valve housing connected in series relationship with the well conduit; a slip joint connected in series relationship with the well conduit intermediate said hollow valve housing and the downhole tool; whereby said hollow valve housing may be shifted axially by the well conduit without moving the downhole tool; a first annular valve element sealingly mounted within the bore of said hollow valve housing and axially shiftable with said valve housing; a support rod insertable within the bore of said hollow valve housing to define an annular fluid passage therebetween; a second annular valve element sealingly mounted on the exterior of said support rod, whereby axial movement of said valve housing in one direction moves said first and second valve elements into axially abutting engagement to close said annular fluid passage, thereby preventing fluid flow through the conduit to the downhole tool, and axial movement of said valve housing in the opposite direction axially separates said first and second valving elements and permits fluid flow from the conduit to the downhole tool; and valve means in said slip joint for opening a fluid connection immediately above the downhole tool between the well annulus and the bore of the well conduit.

17. Valving mechanism for a well conduit communicating with a downhole tool comprising a hollow valve housing connected in series relationship with the well conduit; a slip joint connected in series relationship with the well conduit intermediate said hollow valve housing and the downhole tool; whereby said hollow valve housing may be shifted axially by the well conduit without moving the downhole tool; a first annular valve element sealingly mounted within the bore of said hollow valve housing and axially shiftable with said valve housing; a support rod insertable within the bore of said hollow valve housing to define an annular fluid passage therebetween; a second annuluar valve element sealingly mounted on the exterior of said support rod, whereby axial movement of said valve housing in one direction moves said first and second valve elements into axially abutting engagement to close said annular fluid passage, thereby preventing fluid flow through the conduit to the downhole tool, and axial movement of said valve housing in the opposite direction axially separates said first and second valving elements and permits fluid flow from the conduit to the downhole tool; said slip joint comprising a tubular housing and a tubular mandrel slidably mounted within the bore of said tubular housing; means for connecting the bottom of said tubular housing to the downhole tool; means for connecting the top of said mandrel to said hollow valve housing; a radial port in the lower portions of said tubular housing, and valve means responsive to upward movement of said hollow valve housing for opening said radial port when said first and second valve elements are in said passage closing position.

* * * * *